US006334823B1

(12) United States Patent
Holman

(10) Patent No.: US 6,334,823 B1
(45) Date of Patent: Jan. 1, 2002

(54) LAMINATE MAPLE BASEBALL CONSTRUCTION

(76) Inventor: Sam J. Holman, 93 Bayswater Ave., Ottawa, Ontario (CA), K1Y 2G2

( * ) Notice: Subject to any disclaimer, the term of this patent is extended or adjusted under 35 U.S.C. 154(b) by 0 days.

(21) Appl. No.: 09/551,734

(22) Filed: Apr. 18, 2000

Related U.S. Application Data

(63) Continuation-in-part of application No. 09/073,473, filed on May 6, 1998, now Pat. No. 6,050,910, which is a continuation-in-part of application No. 08/789,041, filed on Jan. 28, 1997, now abandoned.

(51) Int. Cl.[7] ..... A63B 59/06
(52) U.S. Cl. ..... 473/564
(58) Field of Search ..... 473/519, 520, 473/457, 564

(56) References Cited

U.S. PATENT DOCUMENTS

| | | | | | |
|---|---|---|---|---|---|
| 310,248 | A | * | 1/1885 | Brown | 473/564 |
| 514,420 | A | | 2/1894 | Jacobus | |
| 795,815 | A | * | 1/1905 | Burrows | 473/564 |
| 1,121,189 | A | | 12/1914 | Lincoln | |
| 1,450,646 | A | * | 4/1923 | Sadenwater | 473/564 |
| 1,549,803 | A | * | 8/1925 | Rastetter | 473/564 |
| 2,458,919 | A | * | 1/1949 | Marsden | 473/564 |
| 2,944,820 | A | | 7/1960 | Paullus | |
| 3,433,481 | A | | 3/1969 | Tanguay | |
| 5,088,733 | A | | 2/1992 | Barnea et al. | |
| 5,165,686 | A | | 11/1992 | Morgan | |
| 5,620,179 | A | | 4/1997 | Mackay, Jr. | |
| 6,007,440 | A | * | 1/2000 | Bender et al. | 473/564 |
| 6,010,417 | A | * | 1/2000 | Young et al. | 473/564 |

FOREIGN PATENT DOCUMENTS

| | | | |
|---|---|---|---|
| FI | 23495 | 9/1949 | 473/FOR 169 |

OTHER PUBLICATIONS

Article from the Sporting Goods Dealer/Oct. 1977—Cupped Balanced Softball Bat.

* cited by examiner

*Primary Examiner*—Mark S. Graham
(74) *Attorney, Agent, or Firm*—Gifford, Krass, Groh, Sprinkle, Anderson & Citkowski, P.C.

(57) ABSTRACT

A multi-piece and laminate maple baseball bat having an elongate member with a first knob end second barrel end and which is rectangular shaped in cross section with first, second, third and fourth interconnected planar faces. A first plurality of four laminated knob end pieces are secured adhesively in circumferential and interconnecting fashion to associated planar faces of the elongate member proximate the first knob end. A second plurality of laminate and elongate extending barrel pieces are secured adhesively in likewise circumferential and interconnecting fashion to the associated planar faces of the elongate member and at a spaced distance from the first knob end and terminating proximate the second barrel end. A maple bat blank assembled from the adhesively secured first and second pluralities of laminated pieces being subsequently fabricated within a turning machine to create the laminate bat.

10 Claims, 2 Drawing Sheets

LAMINATE MAPLE BASEBALL CONSTRUCTION

CROSS REFERENCE TO COPENDING APPLICATIONS

The present application is a continuation-in-part of U.S. application Ser. No. 09/073,473, filed May 6, 1998, U.S. Pat. No. 6,050,910, which is a continuation-in-part of 08/789,041, filed Jan. 28, 1997, abandoned for a Maple Bat Construction.

BACKGROUND OF THE INVENTION

1. Field of the Invention

The present invention relates generally to the design of wooden baseball bats such as laminate maple bats and, more particularly, to an improved laminate baseball bat construction which is assembleable from a plurality of individual pieces initially secured together with high strength adhesive and which provides a more break-resistant construction while taking advantage of the ability to construct a bat from various scrap pieces and which may also possess a larger diameter barrel.

2. Description of the Prior Art

Baseball bats, particularly those constructed of wood laminate bats various composite bats, are well known in the prior art. The most well known of ash wood laminate bats utilizes several laminates within the handle portion of the bat. Composite bats, or those constructed of more than one type or piece of a selected wood, utilizes various types of wrappings and resins incorporated within the handle portions. This methodology has resulted in "dead" feeling bats which, when utilized by young hitters, cannot provide the precise hitting that is required for solid wood bats. Many young careers in baseball fail because they are imparted with bad hitting mechanics taught by current laminate wood, plastic and metal bats. Additional aspects of prior art bats include the lower grades of wood such as ash, and which are utilized in prior art laminate bats, are generally not as resilient as in higher grades of wood. This results in a ball not traveling as far once it has been hit with a specified degree of force and speed.

U.S. Pat. No. 3,433,481, issued to Tanguay et al., is directed to a reinforced baseball bat wrapping and indicates, at column 1, lines 35–45, that such wrappings have been attempted in the art for such things as maple and mahogany bat designs. However, Tanguay further states that such maple and mahogany bat designs, up to that point in time, would not be economically practicable due to their incidence of breakage. It is well also well known in the earlier art that such bat compositions as mahogany and maple were at the time unsuitable owing to the denser natures of such wood and the relatively primitive nature of earlier manufacture which could not overcome such problems as weight, brittleness and curly graining which made manufacture of such bats for the purpose of game play nearly impossible.

Wooden laminate ash bats, die cast aluminum and magnesium alloy bats are also known in the art, however such bats are not all authorized for professional league play. Accordingly there is still a need in the art for a durable laminate wood bat construction with performance characteristics equal to the solid maple bat in performance, durability, longevity and most importantly the feel of a solid wood baseball bat.

SUMMARY OF THE PRESENT INVENTION

The present invention is a laminate baseball bat formed from a plurality of individual pieces of maple wood, and preferably from ten solid pieces of wood adhesively assembled together to form an initial bat blank. As previously stated, the laminate bat construction of the instant invention makes possible the creation of a durable maple bat from a plurality of individual pieces adhesively secured together into a blank and turned to construct a durable and resilient article.

The bat construction includes an elongate extending member provided as a solid square cross sectional shape and which extends in preferred variants to lengths of up to 36'. The elongate extending member typically includes no laminations and has a first knob end and a second barrel end. The knob end of the elongate member is surrounded by a first plurality of first, second, third and fourth laminated pieces of solid maple. Each of the first through fourth pieces have a specified length, typically no more than 2', are outwardly tapered in cross sectional dimension, the result being that, upon adhesively securing them together, they provide the adhesively assembled bat blank with an evenly aligned and enlarged knob end prior to turning of the blank in the lathe machine.

A second plurality of first, second, third and fourth elongated and laminated pieces of maple, these each extending in a preferred embodiment to an overall length of at least 24', are likewise outwardly tapered in cross sectional dimension and are adhesively secured around a preselected length of the main extending member corresponding to an intermediate length and barrel end length and excluding a handle length of the main member. To provide ideal weighting and performance characteristics to the bat, a second remote end of the main extending member terminates, in the preferred variant, three to six inches short of the corresponding ends of the second plurality of elongated and laminated pieces of maple.

An end cap, typically two inches in length, is inserted into the hollow recess of the barrel end and closes off the hollowed interior of the barrel. It is also envisioned within the scope of the invention that the main member may be one solid and continuous piece terminating at the barrel end and obviating the need for the end cap. It is desirous to have an internally hollowed and axially running section of the barrel, since maple is by nature a denser wood than conventional ash and the axially extending hollowed interior provides the additional feature of resiliency and weighting to the bat. During the turning process of the adhesively assembled bat blank, a "cupping" or recessing is machined into the exposed barrel end of the end cap insert. The degree and curvature of the cavitation formed within the recessed end is made possible by the higher specific gravity exhibited by maple, as opposed to ash, and which further contributes to weight reduction, control and resiliency of the bat.

In most instances, the handle contains no laminations and the grain direction of the bat is determined by placing a label on top of the grain of the handle. Two ribbons that typically occur along the entire length of a solid maple bat will be hidden by the laminations surrounding the square handle portion at the barrel end of the bat. The solid handle is the heart of the bat and gives the feel of a solid maple bat. This handle portion is surrounded by four biased cut approximately two inch long laminate pieces of solid maple to make up the circumference of the knob and the heel taper from the handle portion to the integral knob at the first end. An outwardly tapered and intermediate portion extends from the handle portion and in turn is integrally formed with a ball hitting barrel portion, the barrel portion terminating at a second end. This intermediate portion and second end is connected by the square handle is again surrounded by four biased cut approximately twenty four inch long pieces of solid maple to make up the circumference of the outwardly tapered and intermediate portion extends from the handle portion and in turn is integrally formed with a ball hitting barrel portion at a second end. Within this lamination of the barrel portion a three to six inch section of the handle square is removed. At the second end of the laminated barrel portion a two-inch handle section is inserted to complete the monologue construction of the laminate maple bat barrel. The adjustment of the length of this hollow space enables manufacture of predetermined models of game acceptable weight bats.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENT

Figure 1:
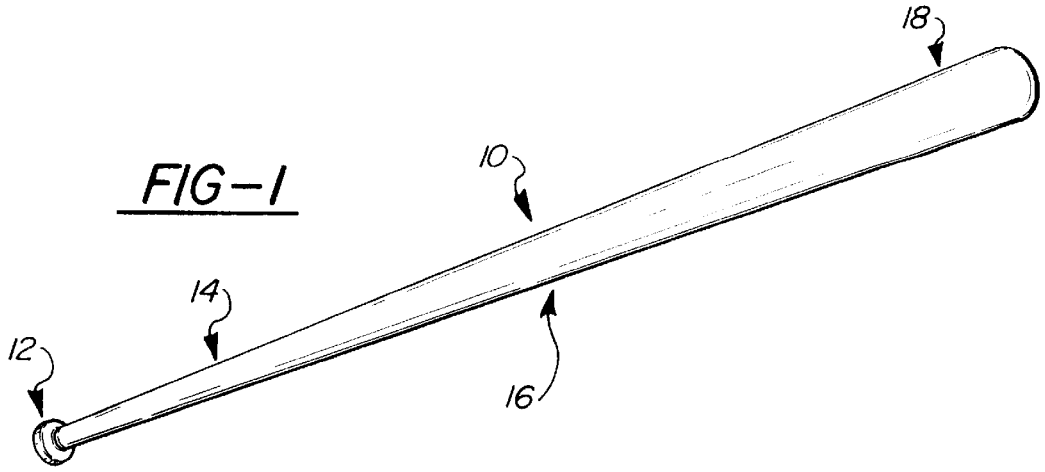
FIG. 1 is a lengthwise elevation view of a completed bat constructed from the laminate maple blank construction according to the present invention.

Referring now to FIG. 1, a laminate and multi-piece baseball bat 10 is illustrated and which is assembled according to the preferred embodiment of the present invention. The bat 10, as previously stated, is capable of being constructed of a plurality of ten individual pieces of maple wood, several of which are laminated. The pieces are initially assembled together as an adhesively secured bat blank, the blank subsequently being mounted within a turning machine and subsequently lathe machined to its desired end configuration.

Figure 2:
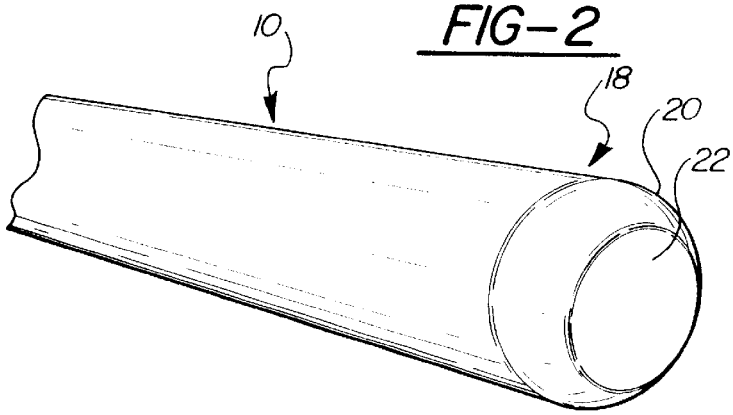
FIG. 2 is end elevational view of the multi-piece and laminate maple bat and illustrating the "cupping" or recessing of the exposed barrel end according to the present invention.

Referring again to FIG. 1, the bat 10 includes a knob end 12, a handle 14, an intermediate length 16 and a barrel end 18. Referring further to the perspective end view of FIG. 2, the barrel end 18 is further defined by a projecting annular end rim 20, within which is defined a cupped or recessed interior cavity 22. Reference is also made to the sectional side and end views of FIGS. 7 and 8, respectively, and which also illustrates the ability to form a first recessed or cupped shape as defined by the surface 22 or, alternatively, according to a further configuration defined by and annular side wall 24 and an interconnecting and annular end wall 26, which can be arranged in any desired angular relationship, and which defines a larger recessed cavity as compared to the surface 22.

Referring to FIGS. 3–6, a collection of views of a multi-piece maple bat blank 28 are illustrated which includes a lengthwise elevational view, first and second end views, and exploded view. The bat construction includes an elongate extending member 30 provided as a solid square cross sectional shape (and having first, second, third and fourth interconnected and planar faces as is clearly evident from the illustrations) and which extends in preferred variants to lengths of up to 36" and with a cross sectional dimension of up to 2.5' along each of first, second, third and fourth faces.

The elongate extending member 30 typically includes no laminations and has a first knob end 32 and a second barrel end 34. The knob end 32 of the elongate member 30 is surrounded by a first plurality of first 36, second 38, third 40 and fourth 42 laminated pieces of solid maple. Each of the first through fourth pieces 36–42 have a specified axial length, typically no more than 2', and which are outwardly tapered in cross sectional dimension from first inner faces equal in cross sectional dimension to the opposingly facing surfaces of the square shaped knob 32 to second parallel and outwardly faced surfaces. The laminate pieces 36–42, upon being adhesively secured together in a circumferential and interconnecting fashion and around the opposingly facing surfaces of the knob end 32 of the extending member 30, provide the adhesively assembled bat blank 28 with an evenly aligned and enlarged knob end prior to turning of the blank in the lathe machine. As is most clearly evident from the end view of FIG. 4 and the exploded view of FIG. 6, an epoxy adhesive (indicated at 43 in FIG. 6) is applied to the opposing inner faces of each of the knob end pieces 36–42 as well as to their interengaging and angled sides and in order to create a tight and complete bonding of the pieces together. It is also envisioned that a durable adhesive, such as an epoxy based adhesive (commercially known as a "carpenters glue") is utilized for securing the various individual pieces of the maple bat blank together and it has been found that such an adhesive provides a desirable and optimum degree of retaining force to the finished item 10.

A second plurality of first 44, second 46, third 48 and fourth 50 elongated and laminated pieces of maple are provided, these each extending in a preferred embodiment to an overall length of at least 24", and are likewise outwardly tapered in cross sectional dimension in similar fashion to each of the first plurality of laminate knob end pieces 36–42. Each of the second plurality of elongate and laminated pieces 44–50 are adhesively secured, again in a circumferential, interengaging and surrounding fashion (just as previously described with reference to the first plurality of knob end pieces 36–42) against the first, second, third and fourth opposing and facing sides of the main extending member 30 and in the same fashion and utilizing the same type of epoxy based or like adhesive as previously described. The arrangement of the second plurality of laminate barrel pieces 44–50 correspond to both an intermediate length and barrel end length (consistent with the positions shown at 16 and 18 of the finished product 10 as illustrated in FIG. 1) of the bat blank and excluding a handle length (as further illustrated at 14 in FIG. 1) of the main member 30. The cross sectional dimensions of each of the second plurality 44–50 of laminate pieces can be equal to those of each of the first plurality 36–42 of knob end laminate pieces, but are preferably somewhat greater in cross section and as is evidenced by the cutaway end view of FIG. 5. The preferred variant of the present invention contemplates each of the elongated and second plurality of laminate pieces 44–50 extending substantially planar in axial direction, combined with being substantially trapezoidal in cross sectional shape. It is however further understood that each of the laminate pieces 44–50 may, within the scope of the invention, be initially provided with an outward taper in its axially running direction to facilitate the subsequent turning process. As previously described, the objective is to provide a finished end product according to the desired and turned configuration 10 and this is also illustrated in phantom in FIG. 3.

Figure 3:
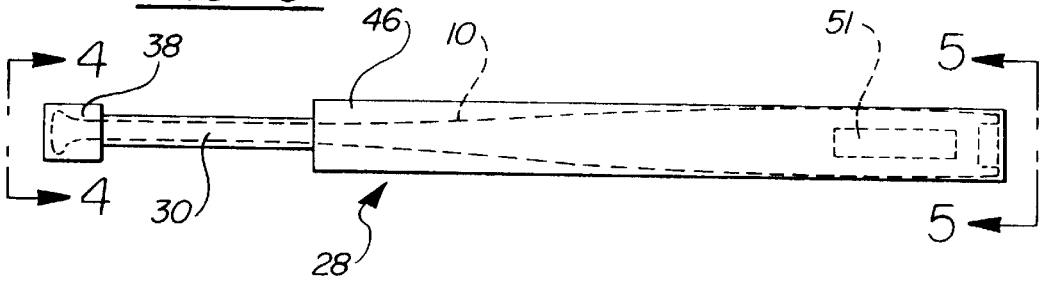
FIG. 3 is a lengthwise elevational view of the laminate maple blank and illustrating in phantom of the desired configuration of the bat to be constructed by the turning operation as well as the hollowed interior aligned with the barrel end according to the present invention.
Figure 4:
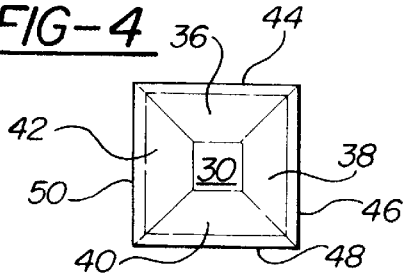
FIG. 4 is an end view taken along line 4—4 of FIG. 3 and illustrating the assembled view of the knob end of the laminate maple blank according to the present invention.
Figure 5:
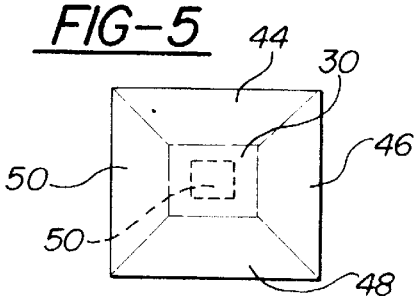
FIG. 5 is an end view taken along line 5—5 of FIG. 3 and illustrating the barrel end of the laminate maple blank according to the present invention.
Figure 6:
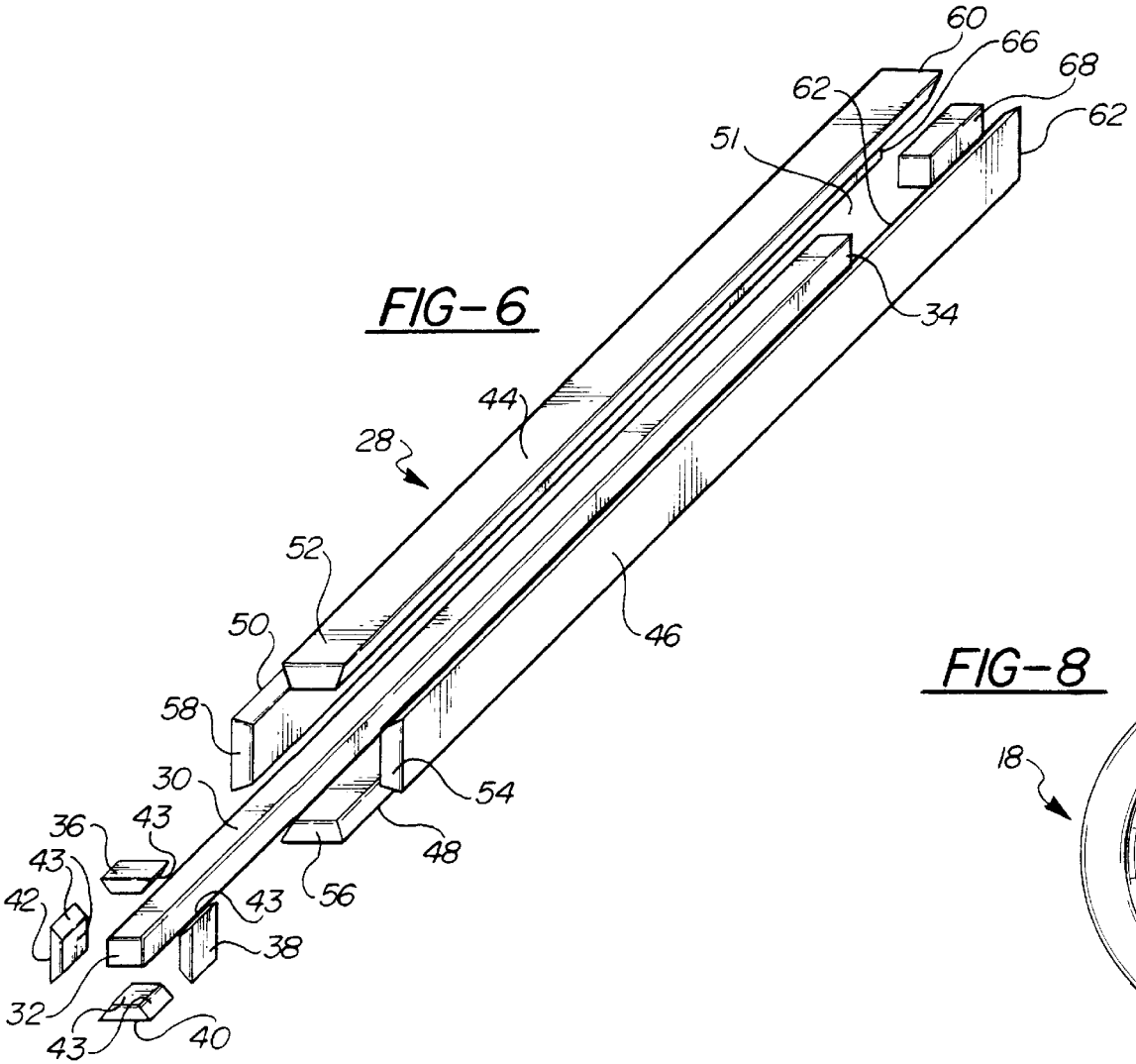
FIG. 6 is an exploded view of the multi-piece maple blank construction according to the present invention.

To provide ideal weighting and performance characteristics to the bat, the barrel end 34, or second remote end of the main extending member 30, terminates three to six inches short of the corresponding ends of the second plurality of elongated and laminated pieces of maple 44–50 and as is evidenced by the axially extending recessed volume 51 as defined both in phantom in the lengthwise elevational view of FIG. 3 and the exploded view of FIG. 6. An end cap 68, typically two inches in axial length and equal in cross section to the main extending member 30, is adhesively secured in inserted fashion into the hollow recessed volume 51 of the barrel end 34 and closes off the hollowed interior of the barrel as illustrated. It is desirous to form the internally hollowed recessed volume 51 at a selected axially running range along the barrel, since maple is by nature a denser wood than conventional ash and the axially extending hollowed interior provides the additional feature of resiliency and weighting to the bat. It is also contemplated that the main member 30 can extend as one solid piece the same axial distance as the elongated and laminated pieces of maple 44–50. Accordingly, it is not necessary, in every embodiment to incorporate an extending recessed volume 51 with an attachment end cap insert 68, as is taught in the first preferred embodiment of the present invention.

Figure 7:
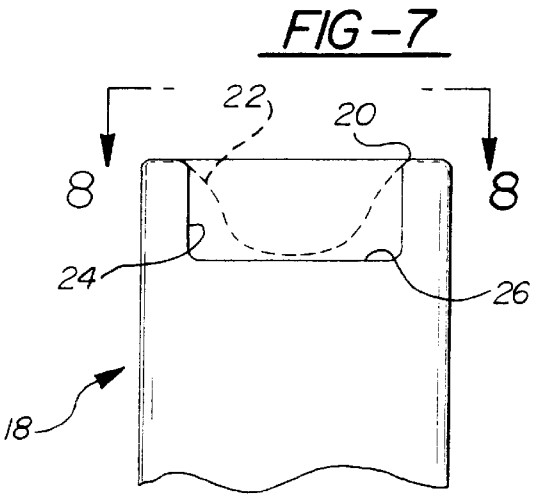
FIG. 7 is a further sectional view enlarged to show the substantially cylindrical shaped and recessed barrel end cavity of the maple bat construction according to the present invention.
Figure 8:
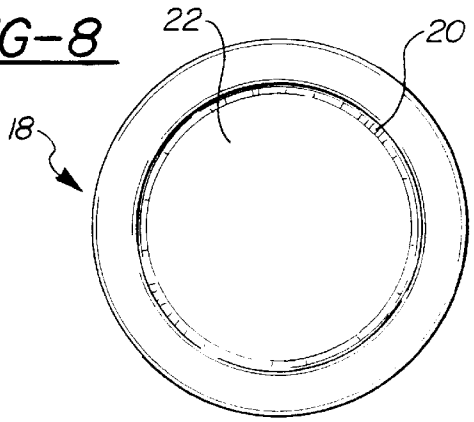
FIG. 8 is an end view of the recessed barrel cavity shown in FIG. 7 and according to the preferred embodiment of the present invention.

During the turning process of the adhesively assembled bat blank, and in addition to the shaping and forming processes along the axially extending knob end, handle, intermediate portion and barrel end portion, the additional "cupping" or recessing is machined into the exposed barrel end of the end cap insert 68 and in the manner as has been previously described with reference to FIGS. 7 and 8. As previously stated, the degree and curvature of the cavitation formed within the recessed end is made possible by the higher specific gravity exhibited by maple, as opposed to ash, and which further contributes to weight reduction, control and resiliency of the bat.

The adhesively assembled maple bat blank, as identified in the collective illustrations of FIGS. 3–6, is axially mounted within a conventional turning machine (not shown) once the applied epoxy adhesive or carpenters glue is allowed a sufficient period to gel and harden. At that point, the generally elongated and rectangular cross sectionally shaped blank construction is turned within the machine and so as to fashion the finished bat 10, within which is formed the axially recessed volume 51 and the inwardly "cupped" barrel end.

As was also previously stated, the advantages of constructing the maple bat from multiple pieces include the ability to utilize otherwise wasted scrap at considerable material savings. The multi-piece laminate construction is further significant in that it permits the incorporation of the hollowed recessed volume 51 in axially extending fashion along the barrel length of the bat, with the result that significantly improved performance and weighting characteristics are imparted into the finished product, and this is further significant when considering that maple by its nature is somewhat denser in material composition as opposed to ash and therefore takes advantage of interior recessing 51 and end face "cupping" of the bat in order to maintain its weight within relevant league requirements. Finally, the composite bat design, and particularly with the use of appropriately sized laminate pieces 44–50, allows the formation of larger cross section barrel sections 18 without creating a significant degree of material scrap and machine process input, and which would otherwise be required in a situation where a single elongate piece of maple would be required for turning and which would have to possess a minimum cross sectional dimension along its entire length at least equal to or greater than the maximum dimension of the barrel end of the finished bat.

Having described my invention, it is evident that it discloses a multiple piece and composite maple bat construction which is a novel improvement over the prior art. Additional preferred embodiments will become apparent to those skilled in the art to which it pertains and without deviating from the scope of the appended claims. In particular, the polygonal cross sectional shape of the main extending member and the pluralities of knob end pieces and laminated barrel pieces could be modified within the scope of the invention, such as by forming the main member in a triangular cross section interengaged by a first plurality of three knob end pieces and a second plurality of three elongate barrel laminate pieces. Additional variants could contemplate a main member with a pentagonal, hexagonal or other cross sectional shape, however common sense would dictate that a lesser number of sides would be preferable in view of the evident increase in fabricating and assembling of a bat blank which would otherwise be attendant with larger pluralities of knob end pieces and barrel pieces.

I claim:

1. A multi-piece and laminate maple baseball bat blank for creating a baseball bat, said blank comprising:

an elongate member having a first knob end and a second barrel end, said elongate member being substantially rectangular in cross section with first, second, third and fourth interconnected planar faces;

a first individual plurality of first, second, third and fourth laminated knob end pieces secured adhesively in circumferential and interconnecting fashion to associated planar faces of said elongate member proximate said first knob end; and a second individual plurality of first, second, third and fourth laminated and elongate extending barrel pieces, each of said barrel pieces having a first end and a second end, said barrel pieces being adhesively secured in circumferential arranged and axially extending manner to said associated planar faces of said elongate member a spaced distance from said first knob end and said first plurality of knob end pieces, said barrel pieces terminating at least proximate said second barrel end;

said maple bat blank assembled from said elongate member and said adhesively secured first and second pluralities of laminated pieces being subsequently fabricated with a turning machine to create a laminate bat.

2. The laminate baseball bat blank according to claim 1, further comprising an axially and interiorly extending hollowed volume extending a specified distance beyond said elongate member and proximate said second end of said barrel pieces.

3. The laminate baseball bat blank according to claim 2, further comprising an end cap being adhesively secured within said hollowed interior at said second end of said barrel pieces.

4. The laminate baseball bat blank according to claim 3, further comprising an annular recess being formed within said end cap.

5. The laminate baseball bat blank according to claim 4, further comprising a projecting annular end rim upon said end cap defining an outer perimeter of said annular recess.

6. The laminate baseball bat blank according to claim 4, said annular recess being defined by a contoured bottom surface.

7. The laminate baseball bat blank according to claim 4, said annular recess being defined by a an annular side wall and an interconnecting and annular shaped end wall.

8. A multi-piece baseball bat blank, comprising:

an elongate member having a first end and a second end, said elongate member being substantially rectangular in cross section with first, second, third and fourth interconnected and planar faces;

a first individual plurality of knob end pieces secured adhesively in circumferential and interconnecting fashion to associated planar faces of said elongate member proximate said first end;

a second individual plurality of first, second, third and fourth elongate extending barrel pieces, each of said barrel pieces having a first end and a second end, said barrel pieces being adhesively secured in circumferential arranged and axially extending manner to said associated planar faces of said elongate member a spaced distance from said first knob end and said first plurality of knob end pieces, said second ends of said barrel pieces each terminating at axial locations extending a selected distance beyond said second end of said elongate member; and an end cap insert adhesively securing in inserting fashion within a hollow recess at said second ends of said barrel pieces and defined by inwardly facing and opposing surfaces of said extending barrel pieces, an axial and recessed volume extending between an inner end of said end cap insert and said second end of said elongate member;

said maple bat blank assembled from said elongate member and said adhesively secured first and second pluralities of laminated pieces being subsequently fabricated with a turning machine to create a bat.

9. A method of manufacturing a baseball bat comprising the steps of:

providing an elongate member having a substantially rectangular shape in cross section with first, second, third and fourth interconnecting and planar faces, said elongate member further including a first end and a second end;

adhesively securing a first individual plurality of knob end pieces in circumferential and interconnecting fashion to associated planar faces of said elongate member and proximate said first end;

adhesively securing a second individual plurality of elongate barrel pieces in circumferential arranged and axially extending manner to associated planar faces of said elongate member and at a spaced distance from said first end and said plurality of knob end pieces; and turning a bat blank assembled from said elongate member and said adhesively secured first and second pluralities of pieces to a desired smooth surface configuration.

10. The method as described in claim 9, further comprising the steps of:

spacing extending ends of said barrel pieces beyond said second end of said elongate member; and inserting and adhesively securing an end cap within a hollow recess defined by said extending ends of said barrel pieces, an axial and recessed volume extending between an inner end of said end cap and said second end of said elongate member.

* * * * *